US008261467B2

(12) United States Patent
Bae et al.

(10) Patent No.: US 8,261,467 B2
(45) Date of Patent: Sep. 11, 2012

(54) LIQUID STORAGE CONTAINER AND CLOTHES DRYER HAVING THE SAME

(75) Inventors: Sang-Hun Bae, Changwon (KR); Min-Ji Kim, Changwon (KR); Ye-Ji Um, Changwon (KR); Myung-Shik Kim, Changwon (KR); Young-Soo Ha, Changwon (KR)

(73) Assignee: LG Electronics, Inc., Seoul (KR)

( * ) Notice: Subject to any disclaimer, the term of this patent is extended or adjusted under 35 U.S.C. 154(b) by 453 days.

(21) Appl. No.: 12/585,847

(22) Filed: Sep. 25, 2009

(65) Prior Publication Data

US 2010/0077630 A1 Apr. 1, 2010

Related U.S. Application Data

(60) Provisional application No. 61/136,710, filed on Sep. 26, 2008.

(30) Foreign Application Priority Data

Sep. 26, 2008 (KR) ..... 10-2008-0094959

(51) Int. Cl.
*F26B 11/02* (2006.01)

(52) U.S. Cl. ..... 34/601; 34/606; 34/610; 427/242; 68/3 R; 68/13 R; 8/142

(58) Field of Classification Search ..... 34/60, 70, 34/80, 90, 595, 601, 606, 610, 78; 427/242; 68/3 R, 13 R; 8/142
See application file for complete search history.

(56) References Cited

U.S. PATENT DOCUMENTS

| | | | | |
|---|---|---|---|---|
| 3,401,052 | A * | 9/1968 | Berger et al. | 427/242 |
| 5,263,267 | A * | 11/1993 | Buttner et al. | 34/519 |
| 6,691,536 | B2 * | 2/2004 | Severns et al. | 68/12.27 |
| 2005/0183208 | A1 * | 8/2005 | Scheper et al. | 8/142 |
| 2008/0201976 | A1 * | 8/2008 | Anderson | 34/60 |
| 2010/0000114 | A1 * | 1/2010 | Dalton et al. | 34/389 |
| 2010/0077630 | A1 * | 4/2010 | Bae et al. | 34/60 |
| 2011/0099834 | A1 * | 5/2011 | Brown | 34/132 |

FOREIGN PATENT DOCUMENTS

| | | |
|---|---|---|
| DE | 3708516 | 9/1988 |
| EP | 1862584 | 12/2007 |
| KR | 10-2003-0088823 A | 11/2003 |
| KR | 10-2005-0052136 A | 6/2005 |
| KR | 10-0741708 B1 | 7/2006 |
| KR | 10-2007-00116502 | 12/2007 |
| KR | 10-2007-0116502 A | 12/2007 |

* cited by examiner

*Primary Examiner* — Stephen M. Gravini
(74) *Attorney, Agent, or Firm* — McKenna Long & Aldridge LLP

(57) ABSTRACT

Disclosed are a liquid storage container and a clothes dryer having the same. The clothes dryer comprises: a body; a front supporter which forms a part of a front surface of the body, and configured to fix the drum; a door installed at the front supporter; a liquid storage container comprising a reservoir configured to store liquid therein, and an inlet unit through which liquid is introduced into the reservoir; and a remaining amount indicator configured to indicate a remaining amount of the liquid stored in the reservoir, wherein the remaining amount indicator is installed on a rear surface of the front supporter, and is exposed to the front surface of the body.

16 Claims, 6 Drawing Sheets

LIQUID STORAGE CONTAINER AND CLOTHES DRYER HAVING THE SAME

RELATED APPLICATION

The present disclosure relates to subject matter contained in priority Korean Application No. 10-2008-0094959, filed on Sep. 26, 2008 and U.S. Patent Application No. 61/136,710, filed on Sep. 26, 2008, which are herein expressly incorporated by reference in its entirety.

BACKGROUND OF THE INVENTION

1. Field of the Invention

The present invention relates to a liquid storage container and a clothes dryer having the same, and particularly, to a liquid storage container capable of storing liquid material such, as fragrant material sprayed into a drum of a clothes is dryer, and the clothes dryer having the same.

2. Background of the Invention

In general, a clothes dryer indicates an apparatus for drying laundry having completely undergone a dehydration process after a washing process, by introducing the laundry into a drum of the clothes dryer, and by evaporating moisture inside the laundry by supplying hot blast into the drum.

As shown in FIG. 1, a body 10 of the clothes dryer comprises a front plate 12 disposed on a front surface of the body 10, and a front supporter 14 disposed on a rear surface of the front plate 12. The front supporter 14 rotatably supports a drum 20 together with a rear supporter (not shown), and provides a door fixing space. A hook 18 is installed at the door 16, and is fixed to a fixing groove 19 disposed at the front supporter 14.

An adjustment panel 30 is provided at an upper end of a front surface of the body 10. The clothes dryer also comprises a driving motor for driving the drum, a blow fan for blowing air into the drum, and a heating means for heating the air introduced into the drum. The heating means may use high-temperature electric resistance heat generated by using an electric resistance, or combustion heat generated by combusting gas.

Air having been discharged from the drum contains moisture of the laundry inside the drum, thereby changing into high-temperature humid air. According to a method for processing the high-temperature humid air, the clothes drier may be classified. More concretely, the clothes drier is classified into a condensation type clothes dryer for condensing moisture inside high-temperature humid air by heat-exchanging the high-temperature humid air with external air through circulation in the clothes dryer without discharging the high-temperature humid air out of the clothes dryer, and an exhaustion type clothes dryer for directly discharging high-temperature humid air having passed through the drum to the outside.

When drawing the laundry having completely undergone a washing process out of a washing machine so as to introduce the laundry into the clothes dryer, a user may have discomfort in smelling odor of used washing water and detergent, or odor of the laundry prior to the washing process. Accordingly, it was required to supply fresh feeling of the laundry to the user by removing the odor of the laundry. For this end, there have been efforts to supply functional material such as fragrant material into the drum. The fragrant material to be stored in a storage container has to be supplied with an appropriate amount corresponding to a usage amount. Accordingly, there has been required a means to allow the user to conveniently check a remaining amount of the fragrant material inside the storage container.

SUMMARY OF THE INVENTION

Therefore, an object of the present invention is to provide a liquid storage container capable of storing liquid material therein and easily checking a remaining amount of the liquid material.

Another object of the present invention is to provide a clothes dryer having a liquid storage container capable of easily checking a remaining amount of liquid material.

To achieve these and other advantages and in accordance with the purpose of the present invention, as embodied and broadly described herein, there is provided a clothes dryer, comprising: a body; a front supporter which forms a part of a front surface of the body, and configured to fix the drum; a door installed at the front supporter; a liquid storage container comprising a reservoir configured to store liquid therein, and an inlet unit through which liquid is introduced into the reservoir; and a remaining amount indicator configured to indicate a remaining amount of the liquid stored in the reservoir, wherein the remaining amount indicator is installed on a rear surface of the front supporter, and is exposed to the front surface of the body.

The remaining amount indicator may be configured to be exposed to the front surface of the body so as to be easily checked by a user's naked eyes in a state that the door has been opened. Accordingly, a remaining amount of the liquid may be checked even in the case that the door is opened so as to put objects to be dried into the clothes dryer. The present invention may be also applied to any apparatus including a liquid storage container for storing liquid having a specific function and sprayed into an object, e.g., a washing machine.

The remaining amount indicator may be integrally formed with the liquid storage container, or may be separately formed from the liquid storage container.

A through hole may be formed at the front supporter. And, the remaining amount indicator may be inserted into the through hole, which may be implemented by inserting the liquid storage container into the through hole.

The remaining amount indicator may comprise a light transmitting portion extending in a lengthwise direction of the reservoir. Through the light transmitting portion, a remaining amount of the liquid stored in the reservoir may be checked. A display portion for providing information about the remaining amount of the liquid may be disposed at one side of the light transmitting portion. And, the display portion may be implemented as a calibration. The display portion may be also implemented as numbers or a belt having different colors, etc.

The clothes dryer may further comprise a floating member floating on the surface of the liquid stored in the reservoir.

The inlet unit may be exposed to outside of the front supporter. The inlet unit may be rotatably installed at the reservoir, and may be opened or closed by being rotated. Also, the inlet unit may be fixed, and may be opened or closed by an additional closure, etc.

According to another aspect of the present invention, there is provided a clothes dryer, comprising: a body; a front supporter which forms a part of a front surface of the body, and configured to fix the drum; a door installed at the front supporter; a liquid storage container comprising a reservoir configured to store liquid therein, and an inlet unit through which liquid is introduced into the reservoir; and a remaining amount indicator configured to indicate a remaining amount of the liquid stored in the reservoir, wherein the remaining amount indicator and the inlet unit are installed on a rear surface of the front supporter, and are exposed to the front surface of the body.

According to still another aspect of the present invention, there is provided a clothes dryer, comprising: a body; a front supporter which forms a part of a front surface of the body, and configured to fix the drum; a door installed at the front supporter; a liquid storage container comprising a reservoir configured to store liquid therein, and an inlet unit through which liquid is introduced into the reservoir; and a remaining amount indicator configured to indicate a remaining amount of the liquid stored in the reservoir, wherein the front supporter comprises a light transmitting portion, and the remaining amount indicator is exposed to the front surface of the body through the light transmitting portion.

The light transmitting portion may comprise a through hole formed at the front supporter. A transparent or a semi-transparent member may be inserted into the through hole.

According to one aspect of the present invention, the remaining amount indicator may be exposed to the front surface of the front supporter that forms a part of a front surface of the clothes dryer. This may allow a user to easily check a remaining amount of the liquid whenever the door is opened.

According to another aspect of the present invention, the inlet unit may be exposed to the front surface of the front supporter. This may facilitate liquid supplementation.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a liquid storage container and a clothes dryer having the same according to the present invention will be explained in more detail with reference to the attached drawings.

Figure 2:
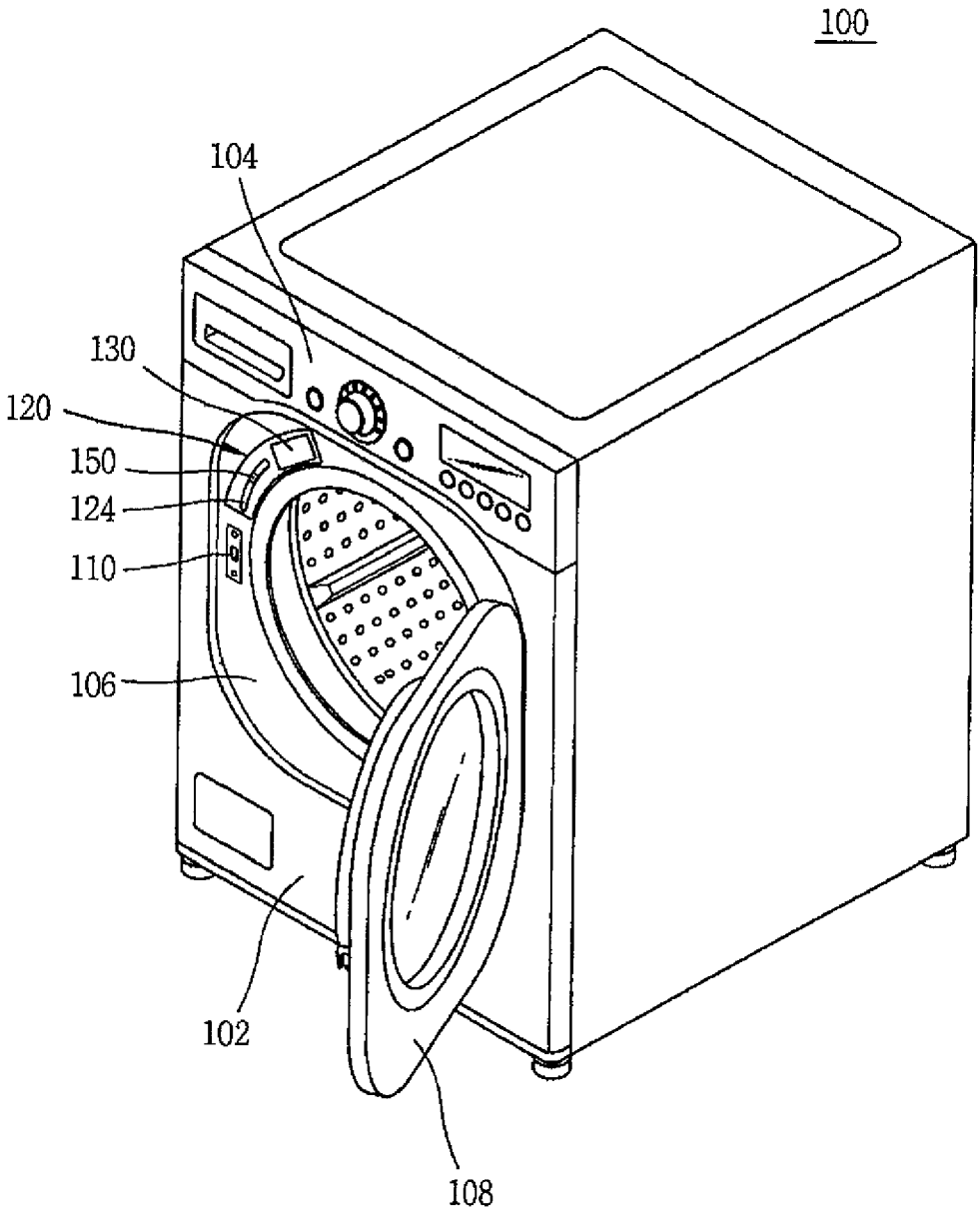
FIG. 2 is a perspective view of a clothes dryer having a liquid storage container according to a first embodiment of the present invention.

FIG. 2 is a perspective view of a clothes dryer having a liquid storage container according to a first embodiment of the present invention. Referring to FIG. 2, a body 100 includes a front panel 102 disposed on a front surface of the body 100, and an adjustment panel 104 disposed at an upper part of the front panel 102. A front supporter 106 for rotatably supporting a drum is disposed on a rear surface of the front panel 102. A door 108 is installed at the front surface of the body 100, and a fixing groove 110 for fixing the door 108 is installed at one side of the front supporter 106.

Figure 3:
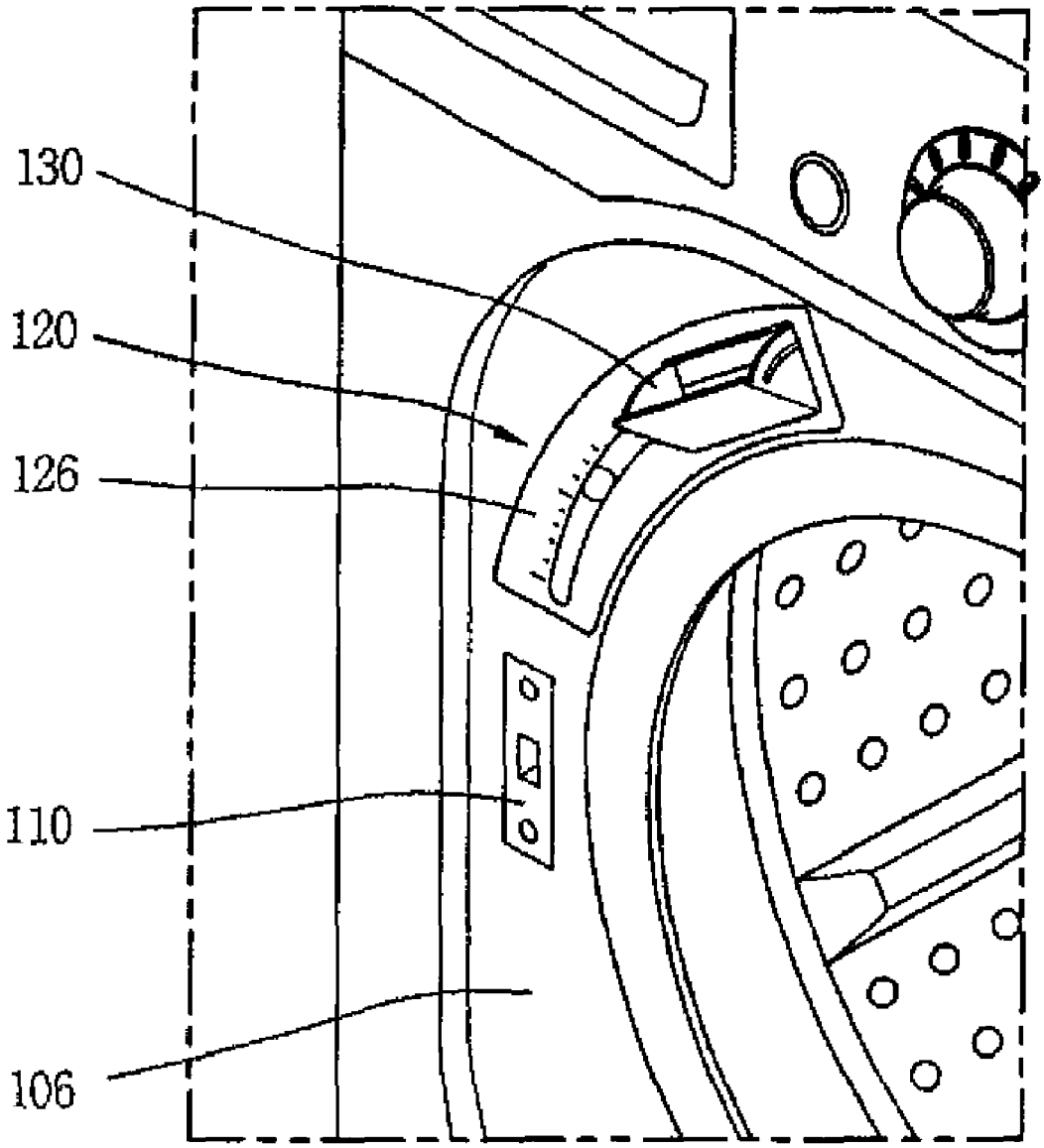
FIG. 3 is an enlarged perspective view of a front surface of the clothes dryer of FIG. 2.

A cover plate 120 is installed at the front supporter 106 in a nine o'clock direction (refer to FIG. 3). An arc-shaped slot 124 is extendingly formed at a lower side of the cover plate 120 in a lengthwise direction of the cover plate 120. And, a floating member 150 that will be later explained may be checked from the outside through the slot 124. An inlet unit 130 that can be opened or closed is rotatably installed at an upper side of the cover plate 120.

FIG. 2 shows that the inlet unit 130 is in a closed state. Referring to FIG. 2, the inlet unit 130 hinge-coupled to the cover plate 120 can be opened by being rotated centering around a hinge shaft. Calibrations 126 are formed on a side surface of the slot 124. Instead of the calibrations 126, any indications for providing information about a remaining amount of liquid, such as numbers, characters, or a belt having different colors may be disposed.

Referring to FIG. 3, a cut-out portion 107 is formed at the front supporter 106. The cut-out portion 107 is formed by cutting a part of the front supporter 106 in correspondence to the shape of the cover plate 120. Accordingly, the cover plate 120 is fixedly-inserted into the cut-out portion 107.

The inlet unit 130 includes a front surface portion 132 and a rear surface portion 134. And, the rear surface portion 134 is communicated with an inlet 142 of a liquid storage container 140 which will be later explained. The front surface portion 132 and the rear surface portion 134 are arranged so as to be inclined with respect to each other, thereby facilitating liquid supplementation. And, the inlet unit 130 is fixedly-inserted into an inlet unit fixing portion 122 formed at the cover plate 120.

Figure 1:
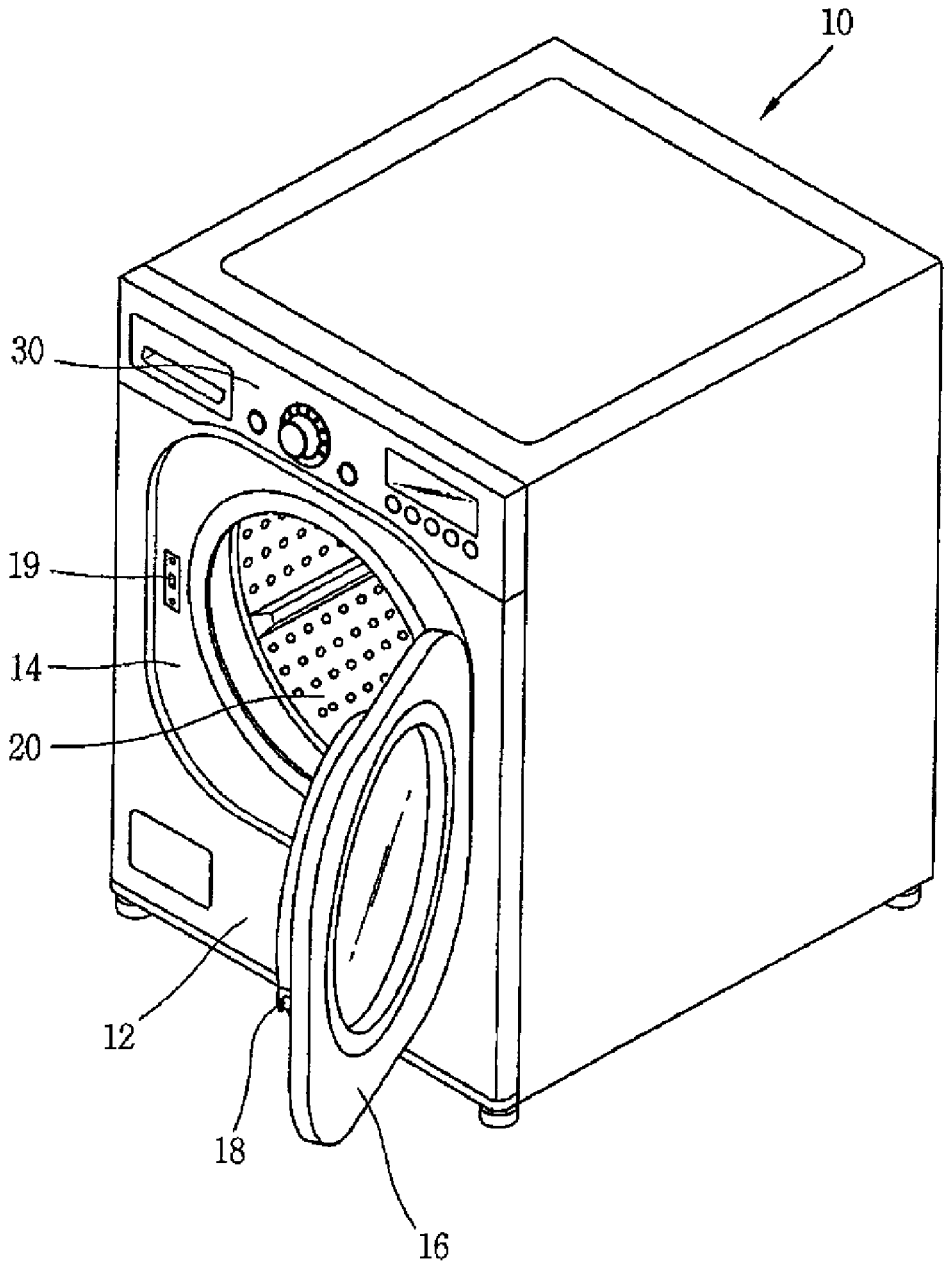
FIG. 1 is a schematic perspective view of a clothes dryer in accordance with the conventional art.

A liquid storage container 140 is installed on a rear surface of the front supporter 106. The liquid, storage container 140 includes an inlet 142 facing the inlet unit fixing portion 122, and an insertion portion 144 disposed to be adjacent to the inlet 142 and fitted into the slot 124 of the cover plate 120. The insertion portion 144 is formed of a transparent or semi-transparent material, and serves as a remaining amount indicator together with the slot 124. And, a floating member 150 (refer to FIG. 1) included in the liquid storage container 140 allows a remaining amount of liquid stored in the liquid storage container 140 to be easily and precisely checked from the outside. Not only the insertion portion 144, but also the entire liquid storage container may be formed of a transparent or semi-transparent material.

The preferred embodiment may have various modifications. For instance, the liquid storage container may be inserted into the cut-out portion 107 without implementing the cover plate. In this case, the calibrations may be disposed on the surface of the front supporter or the liquid storage container. The inlet unit 130 may be also installed at the inlet 142 of the liquid storage container 140 or at the front supporter 106, rather than the cover plate 120.

In the case that the front panel is extending up to a front surface of the cut-out portion 107 of the front supporter 106, the cut-out portion 107 is formed not only at the front supporter 106 but also at the front panel. Accordingly, the remaining amount indicator of the liquid storage container can be exposed to the front surface of the body.

Alternatively, a part of the front supporter, rather than the cut-out portion may be formed of a transparent material. And, the remaining amount of liquid stored in the liquid storage container may be checked through the transparent part.

Figure 5:
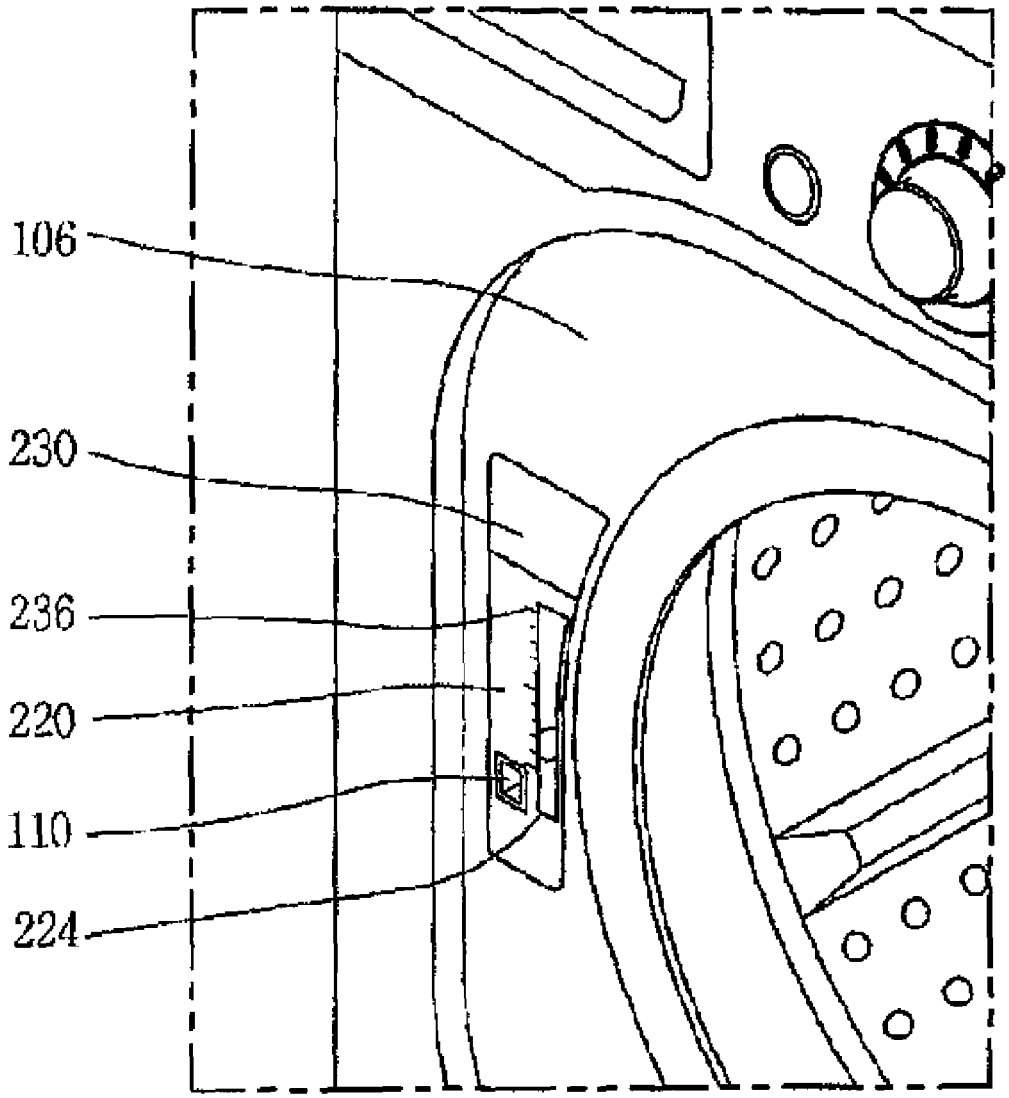
FIG. 5 is a perspective view of a clothes dryer having a liquid storage container according to a second embodiment of the present invention.
Figure 6:
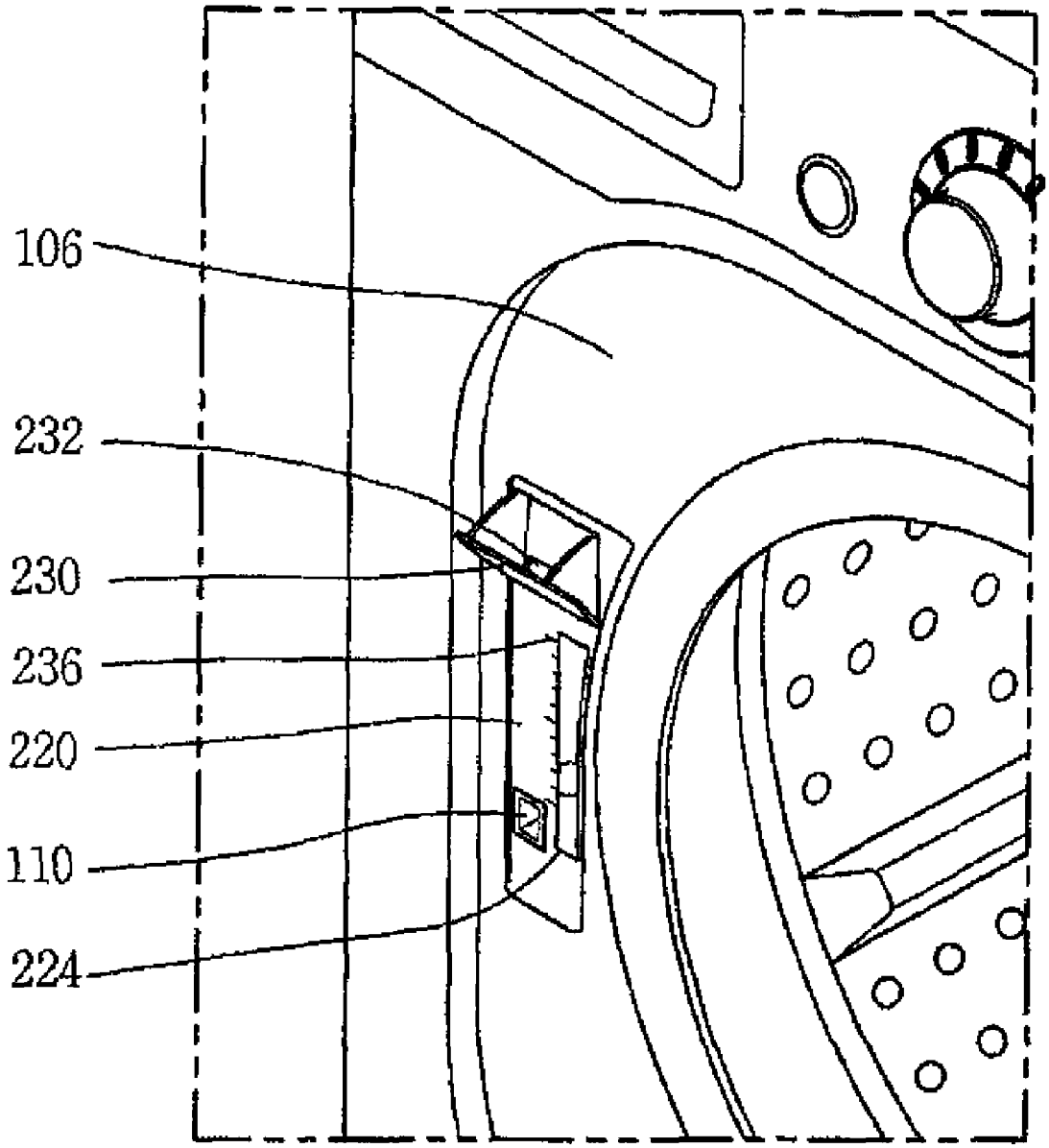
FIG. 6 is a perspective view of the clothes dryer of FIG. 5, which shows an opened state of an inlet unit.

FIGS. 5 and 6 are perspective views of a clothes dryer having a liquid storage container according to a second embodiment of the present invention.

Figure 4:
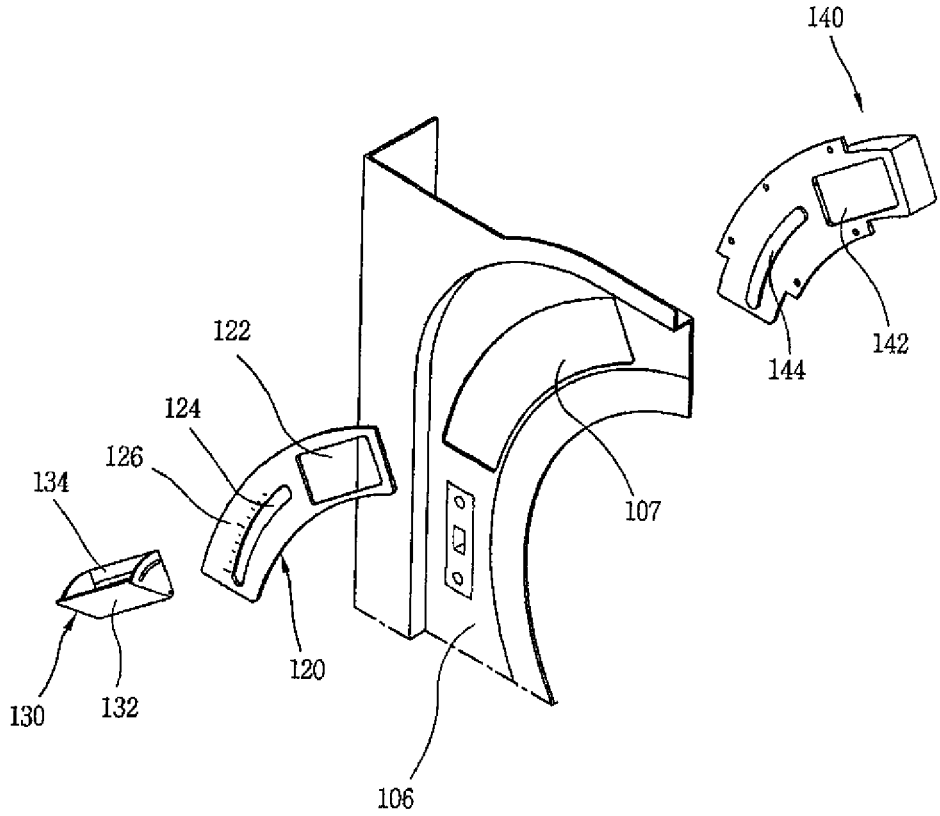
FIG. 4 is an exploded perspective view of a mounting structure for a liquid storage container of FIG. 2.

FIGS. 5 and 6 are different from FIGS. 2 to 4 in that the cover plate 220 is disposed at the left side of the front supporter 106 (in a nine o'clock direction). Accordingly, explanations for the liquid storage container installed on the rear surface of the front supporter will be omitted.

In the second embodiment, since the cover plate 220 is installed at the left side of the front supporter, the fixing groove 110 for fixing a hook of the door is formed at the cover plate 220. And, the slot 224 of the cover plate 220 is disposed in a vertical direction, thereby allowing a user to more easily check the remaining amount of liquid stored in the liquid storage container. Calibrations 236 may be formed at one side of the slot 224.

An inlet unit 230 is rotatably mounted above the slot 224. Once the inlet unit 230 is outwardly rotated as shown in FIG. 6, liquid for supplementation can be introduced into a liquid storage container (not shown) mounted on a rear surface of the front supporter 106, through a communication portion 232 disposed inside the inlet unit.

In the present invention, both the inlet unit and the remaining amount indicator are exposed to the front surface of the body. However, only the remaining amount indicator may be exposed to the front surface of the body. In this case, the inlet unit may be formed at an inner side of the front supporter.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes dryer, comprising:

a body;

a front supporter which forms a part of a front surface of the body, and configured to fix the drum;

a door installed at the front supporter;

a liquid storage container comprising a reservoir configured to store liquid therein, and an inlet unit through which liquid is introduced into the reservoir; and a remaining amount indicator configured to indicate a remaining amount of the liquid stored in the reservoir, wherein the remaining amount indicator is installed on a rear surface of the front supporter, and is exposed to the front surface of the body.

2. The clothes dryer of claim 1, wherein the remaining amount indicator is integrally formed with the liquid storage container.

3. The clothes dryer of claim 1, wherein a through hole is formed at the front supporter, and the remaining amount indicator is inserted into the through hole.

4. The clothes dryer of claim 3, wherein the remaining amount indicator comprises a light transmitting portion extending in a lengthwise direction of the reservoir.

5. The clothes dryer of claim 4, wherein a calibration is disposed at one side of the light transmitting portion.

6. The clothes dryer of claim 5, further comprising a floating member floating on the surface of the liquid stored in the reservoir.

7. The clothes dryer of claim 1, wherein the inlet unit is exposed to the front surface of the body.

8. The clothes dryer of claim 7, wherein the inlet unit is rotatably installed at the reservoir, and is opened or closed by being rotated.

9. A clothes dryer, comprising:

a body;

a front supporter which forms a part of a front surface of the body, and configured to fix the drum;

a door installed at the front supporter;

a liquid storage container comprising a reservoir configured to store liquid therein, and an inlet unit through which liquid is introduced into the reservoir; and a remaining amount indicator configured to indicate a remaining amount of the liquid stored in the reservoir, wherein the remaining amount indicator and the inlet unit are installed on a rear surface of the front supporter, and are exposed to the front surface of the body.

10. The clothes dryer of claim 9, wherein the remaining amount indicator is integrally formed with the liquid storage container.

11. The clothes dryer of claim 9, wherein a through hole is formed at the front supporter, and the remaining amount indicator is inserted into the through hole.

12. The clothes dryer of claim 11, wherein the remaining amount indicator comprises a light transmitting portion extending in a lengthwise direction of the reservoir.

13. The clothes dryer of claim 12, further comprising a floating member floating on the surface of the liquid stored in the reservoir.

14. A clothes dryer, comprising:

a body;

a front supporter which forms a part of a front surface of the body, and configured to fix the drum;

a door installed at the front supporter;

a liquid storage container comprising a reservoir configured to store liquid therein, and an inlet unit through which liquid is introduced into the reservoir; and a remaining amount indicator configured to indicate a remaining amount of the liquid stored in the reservoir, wherein the front supporter comprises a light transmitting portion, and the remaining amount indicator is exposed to the front surface of the body through the light transmitting portion.

15. The clothes dryer of claim 14, wherein the light transmitting portion is implemented as a through hole formed at the front supporter.

16. The clothes dryer of claim 15, wherein a transparent or a semi-transparent member is inserted into the through hole.

* * * * *